United States Patent [19]

Andrews et al.

[11] 4,380,402

[45] Apr. 19, 1983

[54] LIPSTICK-TYPE COSMETIC CASE WITH DISPLAY POSITION

[75] Inventors: Alfred G. Andrews, Wolcott; Charles L. Sorensen, Bristol, both of Conn.

[73] Assignee: Lake Eyelet Manufacturing Company, Inc., Southington, Conn.

[21] Appl. No.: 288,900

[22] Filed: Jul. 31, 1981

[51] Int. Cl.[3] ..... A45D 40/12; A45D 40/06

[52] U.S. Cl. ..... 401/74; 401/77; 401/78; 401/98

[58] Field of Search ..... 401/77, 78, 74, 87, 401/71, 75, 68, 98

[56] References Cited

U.S. PATENT DOCUMENTS

| | | | |
|---|---|---|---|
| 1,695,407 | 12/1928 | Anderson | 401/74 X |
| 1,695,625 | 12/1928 | Wild | 401/74 X |
| 4,108,558 | 8/1978 | Radice et al. | 401/78 X |

*Primary Examiner*—Steven A. Bratlie

*Attorney, Agent, or Firm*—Prutzman, Kalb, Chilton & Alix

[57] ABSTRACT

A lipstick case having an outer sheet metal cam sleeve with a generally helically extending cam slot with an intermediate circumferentially extending pocket for retention of the lipstick pomade in an intermediate display position.

4 Claims, 3 Drawing Figures

LIPSTICK-TYPE COSMETIC CASE WITH DISPLAY POSITION

DESCRIPTION

1. Technical Field

The present invention relates generally to lipstick-type cosmetic cases having a cosmetic pomade carrier adapted to be reciprocated between an inner retracted storage position and an outer extended use position and relates more particularly to a new and improved lipstick-type cosmetic case for retaining the cosmetic pomade carrier in an intermediate position useful in displaying the cosmetic pomade.

2. Background Art

Lipstick-type cosmetic cases conventionally employ inner and outer coaxial cam sleeves and an inner cosmetic pomade carrier having a cam follower received within axial and helical cam slots in the cam sleeves for reciprocating the cosmetic pomade carrier between its retracted and extended positions by relative rotation of the cam sleeves. Such lipstick cases typically have either molded plastic sleeves or sheet metal sleeves formed by rolling sheet metal stampings into the generally cylindrical shape of the cam sleeves.

It has been proposed to package a lipstick and the like with its cosmetic pomade carrier at a predetermined intermediate height to display the color of the cosmetic pomade. Various proposals have been made for retaining the cosmetic pomade carrier in an intermediate position for that purpose. For example, in U.S. Pat. No. 4,108,558, dated Aug. 22, 1978 and entitled "Lipstick Dispenser", an intermediate section is provided in the axial cam track of the inner cam sleeve for holding a lipstick pomade in an intermediate display position by physically restraining the cam follower. In that design, the cam track sleeve must be manufactured within a very close tolerance to provide the desired degree of cam follower restraint. Otherwise, either the cam follower will not be adequately restrained or manual extension and retraction of the pomade will be difficult. Accordingly, a cam sleeve as provided in U.S. Pat. No. 4,108,558 is believed to be impractical particularly if the cam sleeve is made out of a rolled sheet metal stamping since the dimensional tolerance of such sheet metal sleeves is normally somewhat greater than molded plastic sleeves. The present invention is designed to overcome those problems and to provide a practical cam sleeve design for locking the cosmetic pomade carrier in an intermediate position.

DISCLOSURE OF THE INVENTION

In accordance with the present invention, a lipstick type cosmetic case is provided having a new and improved cam sleeve for retaining the cosmetic pomade in an intermediate position. The new and improved cam sleeve provides for holding the cosmetic pomade carrier at a predetermined intermediate position useful for displaying the cosmetic pomade and at the same time offers negligible resistance to the movement of the cosmetic pomade carrier as it is manually extended and retracted. These advantages are accomplished by providing an intermediate pocket in the helical cam track of the outer sleeve which is substantially larger than the width of the cam follower to enable the cam follower to freely follow along the helical cam and which is shaped to prevent inadvertent displacement of the cam follower from the pocket.

The improved cam sleeve design also possesses the advantage of permitting the economical manufacture of the sleeve out of sheet metal in a conventional manner and within the usual manufacturing tolerance which is provided by stamping and then rolling the sheet metal part.

Other advantages achieved by the present invention will be in part obvious and in part pointed out more in detail hereinafter.

A better understanding of the invention will be obtained from the following detailed description and the accompanying drawing of an illustrative application of the invention.

DESCRIPTION OF THE PREFERRED EMBODIMENT

Figure 1:
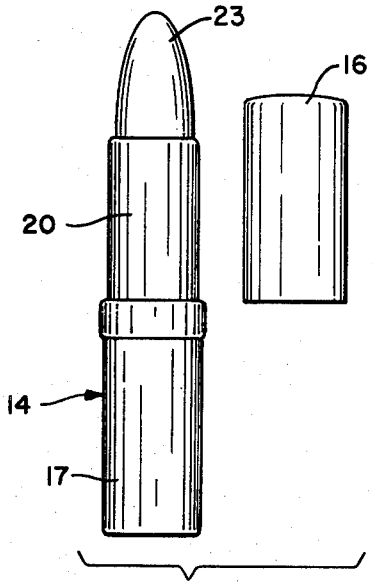
FIG. 1 is a side view of a lipstick incorporating an embodiment of the present invention, showing the top of the lipstick case removed and the lipstick pomade in an intermediate position thereof.

Referring now to the drawing in detail, a lipstick incorporating an embodiment of the present invention has an elongated cosmetic case with a lower tubular holder 14 and an upper tubular top 16 shown removed from the lower holder 14 in FIG. 1. In the shown embodiment, all of the parts of the cosmetic case are made of sheet metal and are of generally conventional construction except as hereinafter described. Accordingly, the cosmetic case will not be described in detail except as necessary to understand the present invention.

In a conventional manner, the holder 14 comprises a tubular base 17, a sleeve assembly mounted on the tubular base 17 and extending axially upwardly therefrom and an outer shell 20 mounted on the sleeve assembly and having an upper cylindrical portion constructed to receive the top 16. A suitable support cup or carrier 22 for the lipstick pomade 23 is mounted within the sleeve assembly.

The sleeve assembly is formed by inner and outer stamped and rolled sheet metal sleeves 24, 32. The inner sheet metal sleeve 24 has an axially extending cam track slot 26 and a radially outwardly projecting circumferentially extending shoulder or bead 30 at its upper end. The inner sleeve 24 has an enlarged lower end 27 suitably rigidly secured within the tubular base 17. The sheet metal outer sleeve 32 is mounted on the inner sleeve 24 and axially retained thereon between its upper retaining bead 30 and a shoulder 34 formed by its enlarged lower end 27.

The outer sleeve 32 is a stamped sheet metal part which, after being stamped, is rolled into a generally cylindrical shape having a diameter slightly larger than its assembled diameter. The outer tubular shell 20 is mounted on the outer sleeve 32 and has an inner cylindrical surface engaged by the outer cylindrical surface of the outer sleeve 32 to accurately establish the diameter of the outer sleeve 32. A generally helical cam track slot 40 is provided by the opposite edges 41, 42 of the rolled sheet metal part 32. The slot shape and dimensions are accurately established within a relatively close tolerance in accordance with the shape of the stamped flat sheet metal part 40 and the accurately established diameter of the outer tubular shell 20.

The pomade carrier 22 has a radially outwardly projecting cam follower 46 that is received by the cooperating cam track slots 26, 40 of the sleeve assembly to reciprocate the carrier between its retracted and extended axial positions. The outer sleeve 32 and inner sleeve 24 are adapted to be relatively rotated to retract and extend the pomade carrier 22. Such relative rotation is normally accomplished by grasping the outer shell 20 in one hand to hold the outer sleeve 32 against rotation and rotating the base 17 with the other hand to rotate the inner sleeve 24. Two generally semi-circular track pockets 39 are provided at the opposite ends of the helical cam track slot 40 for receiving the cam follower 46 and thereby lock the pomade carrier against inadvertent displacement from its extended and fully retracted axial positions.

In accordance with the present invention, the outer sleeve 32 is designed to form a circumferentially extending cam track slot section 50 intermediate the helical cam track slot sections 51, 52 extending in opposite axial directions from the intermediate track section 50. The intermediate track section 50 is provided by axially oppositely facing generally concave edges 54, 55 and by a pair of oppositely axially projecting edges or lobes 56, 57 and 58, 59 at each circumferential end of the opposed concave edges 54, 55. The intermediate track section 50 thereby forms an enlarged pocket for receiving and holding the cam follower 46 at an intermediate axial position where the lipstick pomade 23 is partly extended as shown in FIG. 1 for display. In that regard, it is contemplated that the lipstick and its top 16 will be packaged for sale, for example in a suitable blister pack, with the top 16 removed and with the lipstick pomade 23 visible in its intermediate position shown in FIG. 1. A prospective purchaser can then readily determine the color of the lipstick pomade 23 without handling the lipstick or removing the lipstick from its package.

The enlarged pocket formed by the intermediate track section 50 is substantially larger than the diameter or width of the cam follower 46. The slot width between each pair of end lobes 56, 57 and 58, 59 is greater than the diameter of the cam follower 46 so that the cosmetic case can be easily manually operated in a normal manner to shift the pomade carrier 22 between its fully extended and fully retracted positions. However, the slot width between each pair of end lobes 56, 57 and 58, 59 is preferably slightly less than the track width of the helical cam track sections 51, 52. Therefore, the cam track 40 narrows slightly to form throat interconnections between the intermediate track section 50 and the helical track sections 51, 52.

Figure 2:
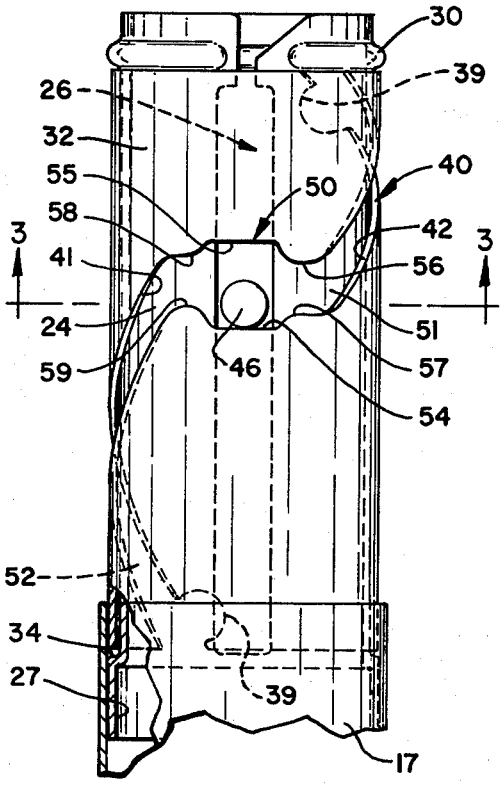
FIG. 2 is an enlarged partial side view, partly broken away, of a lipstick holder of the case with an upper decorative shell thereof removed.
Figure 3:
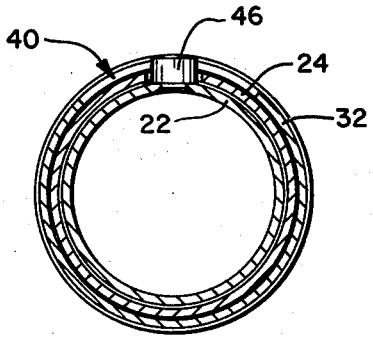
FIG. 3 is a transverse section view, partly in section, of the lipstick case taken generally along the line 3—3 of FIG. 2.

The relatively large pocket formed by the intermediate track section 50 retains the follower against inadvertent displacement from its intermediate position. Thus, after the lipstick pomade 23 is placed in its intermediate position where the cam follower 46 is received within the enlarged pocket, the lipstick pomade 23, in either its upright position shown in FIGS. 1 and 2 or in an inverted position (not shown), will be retained against inadvertent displacement along the helical slot 40 by the concave pocket sections 54, 55 of the intermediate track section 50. In the upright and inverted positions of the lipstick, the weight of the pomade 23 will hold the follower 46 in engagement with the edges 54 and 55 respectively, and in each such position, the cam follower 46 is held against inadvertent displacement along the helical cam track 40 by the adjacent retaining lobes 57, 59 or 56, 58. The two concave edge sections 54, 55 are directly opposed to each other so that when inverting the lipstick, the follower 46 will axially shift out of engagement with one of the concave edge sections 54, 55 into engagement with the other edge section without chance of inadvertent displacement into one of the helical track sections 51 or 52.

The size and shape of the intermediate track section 50 is held to the desired size and shape by the outer tubular shell 20 even though a stamped sheet metal part is employed to form the outer sleeve 32. For that reason, the intermediate track section 50 is provided in the outer sleeve 32. Also, the intermediate track section 50 is provided in the helical cam slot 40 rather than in the axial cam slot 26 so that the pomade weight helps retain the cam follower 46 within the pocket when the lipstick is inverted. If an intermediate pocket were provided in the axial slot, the pomade weight transmitted through the cam follower 46 to the helical cam could cause relative rotation of the inner and outer sleeves 24, 32 to shift the cam follower 46 out of the retaining pocket.

As will be apparent to persons skilled in the art, various modifications and adaptations of the structure above described will become readily apparent without departure from the spirit and scope of the invention, the scope of which is defined in the appended claims.

We claim:

1. In a lipstick type cosmetic case having a generally cylindrical sleeve assembly with inner and outer, manually relatively rotatable, generally cylindrical sleeves and a cosmetic carrier axially reciprocable within the sleeve assembly between retracted and extended axial positions thereof, the carrier having a radially outwardly projecting cam follower and the two sleeves having respectively generally axially and helically extending cooperating cam track slots receiving the cam follower for manually reciprocating the carrier between its retracted and extended axial positions by manual relative rotation of the inner and outer sleeves, the generally helically extending cam track slot having helically extending cam track slot sections and an intermediate cam track slot section therebetween for selectively positioning the carrier intermediate its retracted and extended positions, the improvement wherein the intermediate cam track slot section is a circumferentially extending section having a cam track slot width greater than the width of the cam follower along the entire circumferential length of said intermediate section to permit the cam follower to freely follow therealong between said helically extending cam track slot sections and comprises a pair of axially oppositely facing generally concave cam track edges, each having a central recessed track edge portion with a circumferential length greater than the width of the cam follower and rounded convex end lobe track edge portions at the circumferential ends thereof, to form an intermediate cam track slot pocket with a pair of axially opposed end lobe track edge portions at each circumferential end thereof to retain the cam follower against inadvertent displacement from the pocket in axially upright and inverted positions of the cosmetic case and yet to permit the cam follower to move freely along the intermediate cam track slot section between said helically extending cam track slot sections upon manual relative rotation of the two sleeves.

2. A cosmetic case according to claim 1 wherein the intermediate cam track slot section has relatively narrow throat sections leading in opposite directions from the pairs of end lobes and connecting the intermediate cam track slot section to the remainder of the generally helically extending cam track slot.

3. A cosmetic case according to claim 1 wherein the inner and outer sleeves are rolled sheet metal parts.

4. A cosmetic case according to claim 1 wherein said outer sleeve is a rolled generally cylindrical sheet metal part having contoured edges at opposite circumferential ends thereof circumferentially spaced to form said generally helically extending cam track slot and wherein the cosmetic case further comprises an external cylindrical casing firmly receiving and establishing the diameter of the rolled outer sheet metal sleeve to accurately establish said circumferential spacing of said contoured edges of said rolled sheet metal part.

* * * * *